US009011192B2

(12) United States Patent
Canobbio

(10) Patent No.: US 9,011,192 B2
(45) Date of Patent: Apr. 21, 2015

(54) GRAVITY-SLOWING SELF PROPELLING GAME DEVICE

(71) Applicant: Dan Kevin Canobbio, Frisco, TX (US)

(72) Inventor: Dan Kevin Canobbio, Frisco, TX (US)

(73) Assignee: Dan Kevin Canobbio, Frisco, TX (US)

( * ) Notice: Subject to any disclaimer, the term of this patent is extended or adjusted under 35 U.S.C. 154(b) by 0 days.

(21) Appl. No.: 14/292,836

(22) Filed: May 31, 2014

(65) Prior Publication Data

US 2014/0357149 A1 Dec. 4, 2014

Related U.S. Application Data

(60) Provisional application No. 61/830,056, filed on Jun. 1, 2013.

(51) Int. Cl.
*A63H 27/00* (2006.01)
*A63B 67/10* (2006.01)

(52) U.S. Cl.
CPC ..... *A63H 27/12* (2013.01); *A63B 67/10* (2013.01)

(58) Field of Classification Search
USPC ..... 446/36, 37, 175, 225; 473/594, 595, 473/604, 609
See application file for complete search history.

(56) References Cited

U.S. PATENT DOCUMENTS

| | | | | |
|---|---|---|---|---|
| 3,662,487 | A * | 5/1972 | Seefluth | 446/37 |
| 5,403,222 | A * | 4/1995 | Koenig et al. | 446/220 |
| 8,011,222 | B2 * | 9/2011 | Wiber | 73/12.09 |

* cited by examiner

*Primary Examiner* — Nini Legesse

(57) ABSTRACT

The game device for a user including a flexible closure for receiving impacts from the user, one or more filler placed inside the flexible closure for reducing recoiling of the flexible closure from the surface on receiving impacts, a mechanical unit attached to the inner walls of the flexible closure and a gravity slowing unit attached to the mechanical unit for reducing the gravitational pull acting on the flexible closure. The mechanical unit includes an electric motor for providing torque, an impact sensor for sensing the impacts received from the user, and a power source for energizing the electric motor and the impact sensor. The gravity slowing unit includes a spring-loaded hinge for stabilizing the flexible closure from impacts projected by the user, a spring-loaded shaft connected to the electric motor through the spring-loaded hinge for rotating to rotate on receiving torque from the electric motor and at least one set of propellers connected to the spring-loaded shaft for the receiving torque and providing thrust against gravitational pull acting on the flexible closure.

8 Claims, 4 Drawing Sheets

GRAVITY-SLOWING SELF PROPELLING GAME DEVICE

CROSS REFERENCE TO RELATED APPLICATION

This application claims priority to a U.S. Provisional Application No. 61/830,056 filed on Jun. 1, 2013, the entire content of which is incorporated herein by references in its entirety.

BACKGROUND OF THE INVENTION

1. Field of he Invention

The present invention generally relates to a game device related to a footbag and more particularly relates to a game device including a footbag and a gravity-slowing self propelling unit to reduce the skill level required by a player.

2. Description of Related Art

People have always been fascinated with the concept of intercepting a flying object and batting such object back into the air so as to keep such object from reaching the ground. This fascination has resulted in a number of games, such as volleyball, that test a person's skill in keeping a particular object from reaching the ground.

Many games, exercises and devices have been created for developing one's eye-to-foot coordination. In such games and exercises the object is intercepted by the foot and/or knee and kicked repeatedly into the air. Such games and exercises have been found to be extremely helpful in developing not only eye-to-foot coordination, but also the balance and quickness necessary for performing a variety of sports such as baseball, football, basketball, soccer, karate and tennis.

These games and exercises have been found to be especially pleasurable and beneficial when the person performs a wide variety of kicks and is able to kick the object with all parts of the feet and knees. Because the foot and knee generally are not as easily manipulated as the hand, objects suitable for exercises and games wherein the purpose is to keep the object in the air for as long as possible using only the feet and knees must be very light weight and reach the ground as slow as possible to spare time to the player to react and respond well.

Furthermore, the reaction of the object must be consistent and independent of the trajectory in which the object is hit or kicked. In this way, the object may be kicked with the instep, the heel or the toe of the foot and still get a consistent and reliable response. Therefore there is a need for a game device that increases the time spent in the air by the object and makes the reaction of the kick independent of the trajectory in which the object is hit.

SUMMARY OF THE INVENTION

In accordance with the teachings of the present invention, a game device for receiving impacts from a user during recreational activities that increases the time spent in air by the object is provided.

An object of the present invention is to provide the game device including a flexible closure for receiving impacts from the user, one or more filler placed inside the flexible closure for reducing recoiling of the flexible closure from the surface on receiving impacts, a mechanical unit attached to the inner walls of the flexible closure and a gravity slowing unit attached to the mechanical unit for reducing the gravitational pull acting on the flexible closure.

The mechanical unit includes an electric motor for providing torque, an impact sensor for sensing the impacts received from the user, and a power source for energizing the electric motor and the impact sensor. The gravitational slowing unit includes a spring-loaded hinge for stabilizing the flexible closure from impacts projected by the user, a spring-loaded shaft connected to the electric motor through the spring-loaded hinge for rotating on receiving torque from the electric motor, at least one set of propellers connected to the spring-loaded shaft for receiving torque and providing thrust against gravitational pull acting on the flexible closure.

Another object of the present invention is to provide either sand or pallets as filler for filling the flexible closure to reduce the recoiling. Further, the spring-loaded hinge is a ball hinge. Furthermore, another object of the present invention is to provide a game device wherein the impact sensor disables the propellers for a predetermined duration on sensing gravitational pull on the flexible closure.

Another object of the present invention is to provide an output unit to play audio/visual and controlled by impact sensor. Further, the gravity slowing unit includes a ring for circumscribing the at least one set of propellers. The ring covers the propellers to ensure safety of the user from getting injured.

These and other features and advantages will become apparent from the following detailed description of illustrative embodiments thereof, which is to be read in connection with the accompanying drawings.

BRIEF DESCRIPTION OF DRAWINGS

The disclosure will provide details in the following description of preferred embodiments with reference to the following figures wherein.

Figure 1:
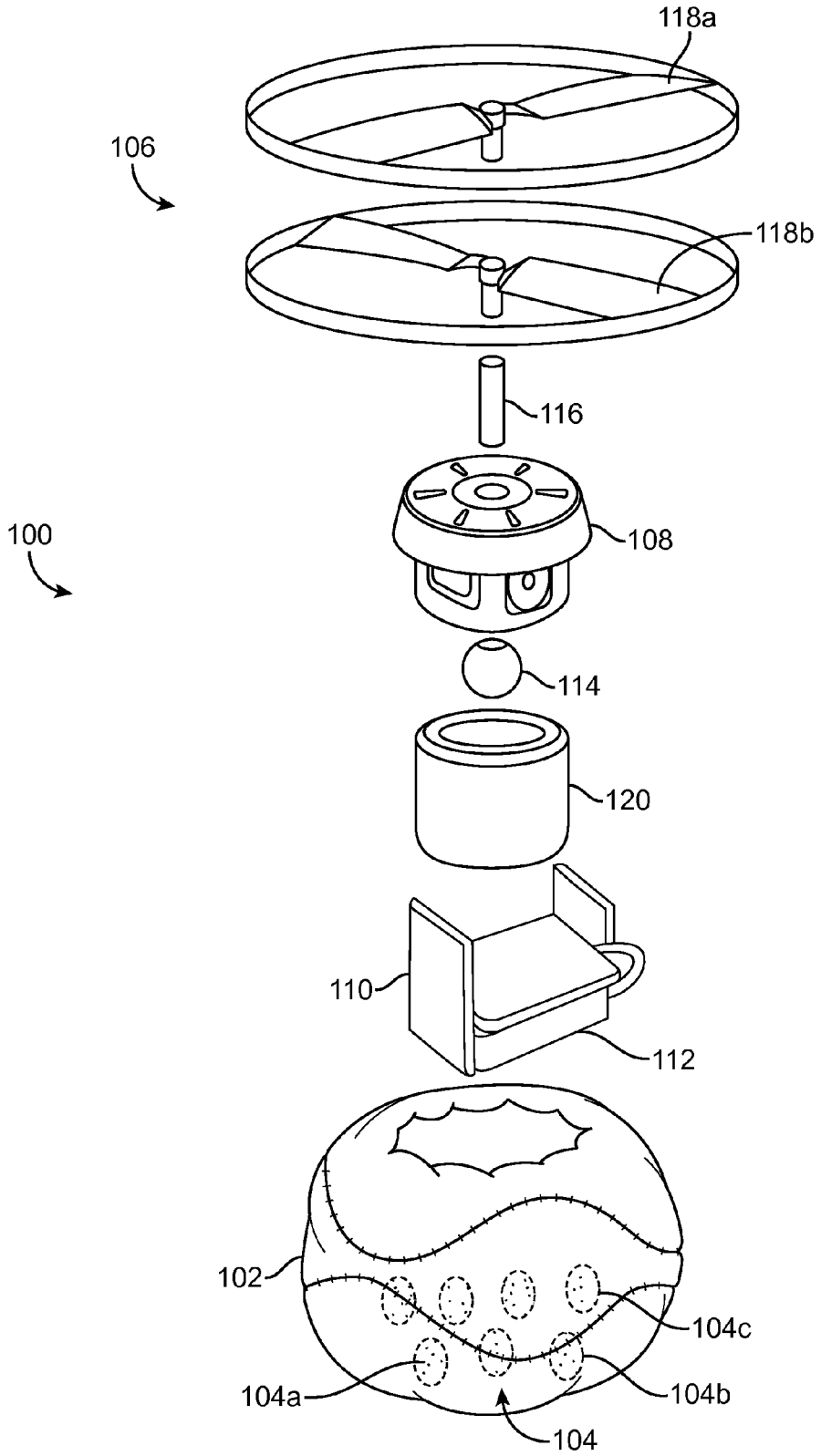
FIG. 1 illustrates an exploded view of a game device in accordance with a preferred embodiment of the present invention.

The foregoing summary, as well as the following detailed description of certain embodiments of the present invention, will be better understood when read in conjunction with the appended drawings. For the purpose of illustrating the invention, certain embodiments are shown in the drawings. It should be understood, however, that the present invention is not limited to the arrangements and instrumentality shown in the attached drawings.

DETAILED DESCRIPTION OF THE DRAWINGS

While the specification concludes with claims defining the features of the invention, a game device for recreational purpose and kinetic sport will be better understood from a consideration of the following description in conjunction with the figures, in which every major element has been given a reference number. As required, the detailed embodiments of the present invention have been included herein. However, it must be understood that the disclosed embodiments are merely exemplary of the invention, which may be embodied in various forms. Therefore, the structural and functional details that have been disclosed should not be interpreted as limiting. They must merely be taken as the basis for the claims and as a representative basis for teaching one skilled in the specific domain to variously employ the present invention in virtually any appropriately detailed structure. Further, the terms, phrases and examples used herein are not intended to be limiting, but are rather intended to provide an understandable description of the invention.

FIG. 1 illustrates an exploded view of a game device 100. The game device 100 includes a flexible closure 102, one or more filler 104, a mechanical unit 104 and a gravity slowing unit 106. The flexible closure 102 receives impacts from the user. In a preferred embodiment of the present invention, the flexible closure 102 is a footbag to receive impact from the foot of the user. The user kicks in a way to move the flexible closure 102 in upward direction. The flexible closure 102 is explained in detail in conjunction with FIG. 2 of the present invention.

The one or more filler 104 such as 104*a*, 104*b* and 104*c* are placed inside the flexible closure 102 for reducing recoiling of the flexible closure 102 from the surface on receive impacts from the user. In a preferred embodiment of the one or more filler 104 is sand. However it will be readily apparent to those skilled in the art that many other filler 104 may also be envisioned without deviating from the scope of the present invention.

The mechanical unit 106 is attached to the inner walls of the flexible closure 102. The mechanical unit 106 includes an electric motor 108 for providing torque, an impact sensor 110 for sensing the impacts received from the user and a power source 112 for energizing the electric motor 108 and the impact sensor 110. The power source 112 and the impact sensor 110 are explained in detailed in conjunction with FIG. 2 of the present invention.

The gravity slowing unit 106 is attached to the mechanical unit for reducing the gravitational pull acting on the flexible closure 102. The gravity slowing unit 106 includes a spring-loaded hinge 114 for stabilizing the flexible closure 102 from impacts projected by the user, a spring-loaded shaft 116 connects to the electric motor 108 through the spring-loaded hinge 114, and at least one set of propellers 118 such as 118*a*, and 118*b* connected to the spring loaded shaft 114 for receiving torque and providing thrust against gravitational pull acting on the flexible closure 102.

In a preferred embodiment of the present invention the spring-loaded hinge 114 is a ball hinge. However, it would readily apparent to those skilled in the art that various other types of spring-loaded hinge 114 may also be envisioned without deviating from the scope of the present invention.

In another embodiment of the present invention, the impact sensor 110 disables at least one set of propellers 118 for a pre-determined duration after receiving impact from the user on the flexible closure 102. An exemplary embodiment on disablement of at least one of the one set of propellers 118 after a pre-determined duration is explained in detail in conjunction with FIG. 4 of the present invention.

In another embodiment of the present invention, the game device 100 includes a casing 120 configured for covering the electric motor 108 and the spring-loaded hinge 114. It would be readily apparent to those skilled in the art that various types and forms of the electric motor 108, casing 120, and propellers 118 may be envisioned without deviating from the scope of the present invention.

Figure 2:
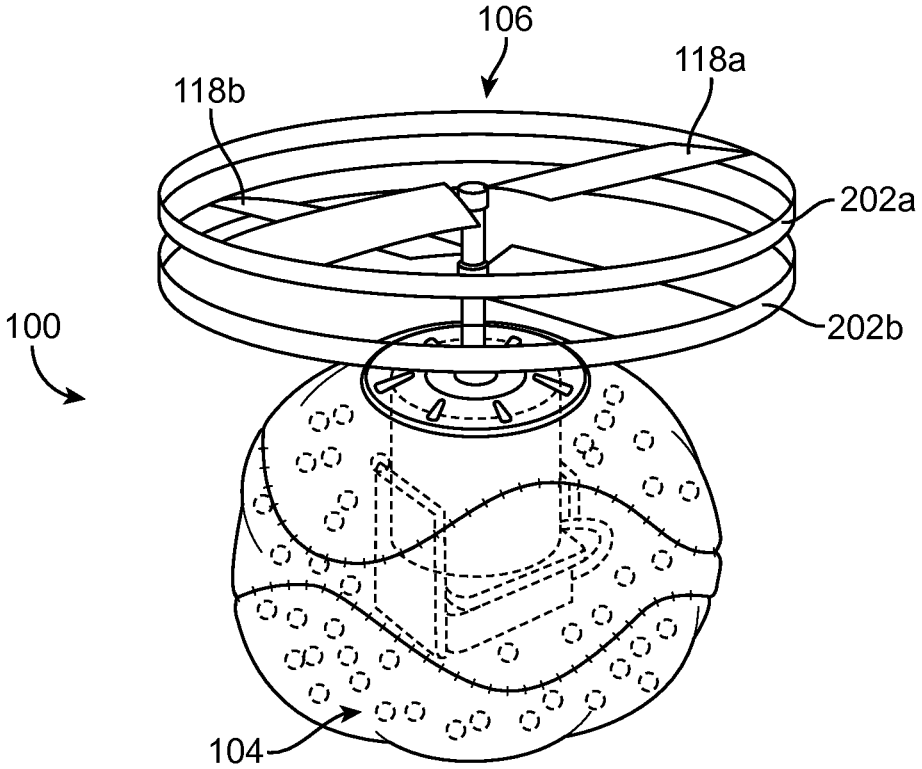
FIG. 2 illustrates a perspective view of the game device in accordance with another preferred embodiment of the present invention.

FIG. 2 illustrates a perspective view of the game device 100 in accordance with a preferred embodiment of the present invention. In another embodiment of the present invention examples of one or more filler 104 may also include pallet, stones etc. Further in another embodiment of the present invention, the gravity slowing unit 106 further includes one or more rings 202 such as 202*a* and 202*b* for circumscribing propellers 118 such as 118*a* and 118*b* respectively.

Figure 3:
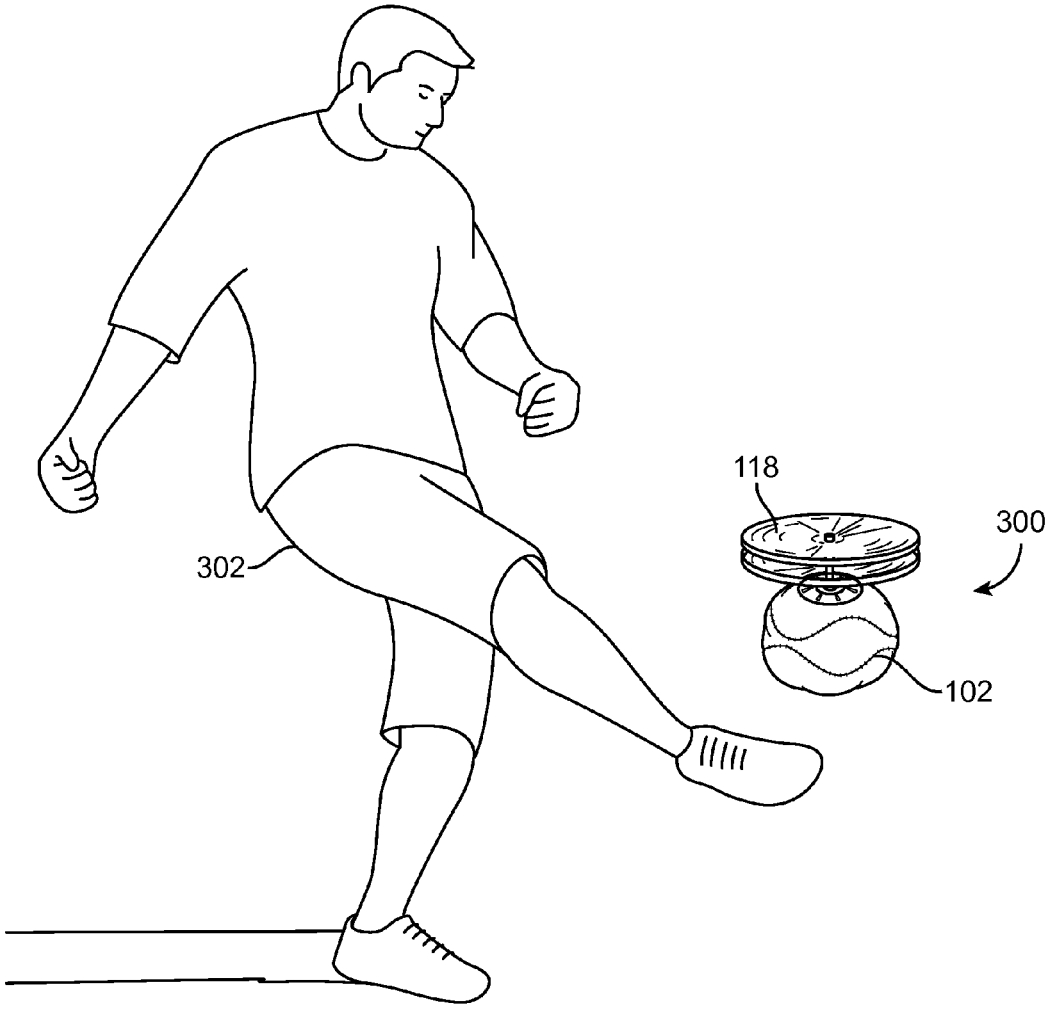
FIG. 3 illustrates an exemplary embodiment of the game device with activated propellers.

FIG. 3 illustrates a game device 300 receiving impact from a user 302 in accordance with an exemplary embodiment of the present invention. The user 302 kicks the fixed closure 102, and the impact sensor detects the impact on the fixed closure 102 and results in activation of the propellers 118 via the electric motor. Further, the thrust produced by at least one set of propellers 118 facilitates in keeping the flexible closure 102 in air for longer duration by reducing the weight.

Figure 4:
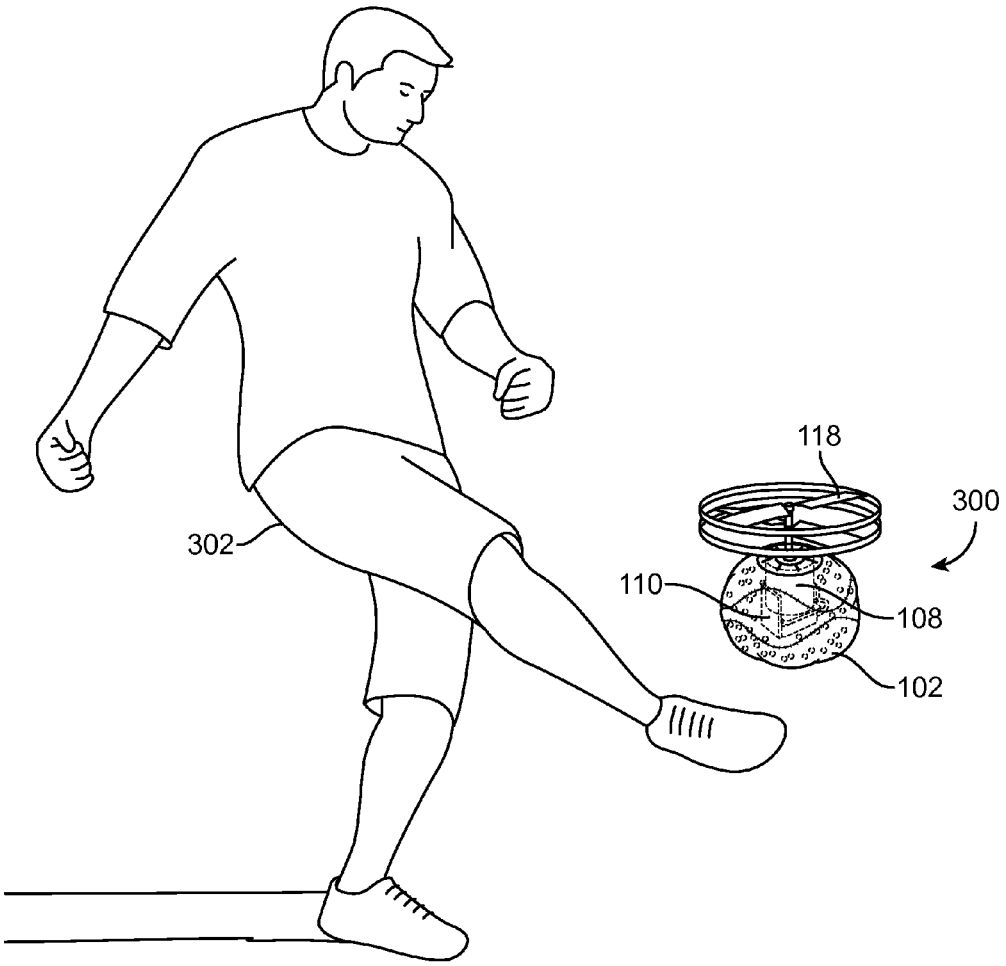
FIG. 4 illustrates another exemplary embodiment of the game device with disabled propellers.

FIG. 4 illustrates a game device 300 with disabled propellers 118 in accordance to another exemplary embodiment of present invention. The impact sensor 110 may be pre-programmed to disable the propellers 118 after a certain period of time. For example, the impact sensor 110 disables the propellers 118 through the electric motor 108 after 10 seconds of receiving the impact from the user 302 for providing stability to the flexible closure 102 and to enhance the game play.

In another exemplary embodiment of the present invention, the impact sensor 110 disables the propellers 116 after 10 seconds of receiving the impact from the user 302 for 5 seconds to provide stability to the flexible closure 102 and enhance the game play. However, it would readily apparent to those skilled in the art that other time duration may also be envisioned without deviating from the scope of the present invention.

The present invention offer various advantages such as the game apparatus is now more interactive with the user due to the presence of the gravity slowing unit. With the use of propellers controlled through the impact sensor certainly brings back the interest of users playing footbag. Now, the player has more time to play with the fixed closure acting under gravitational pull and thus more providing more balance on the foot of the player.

The foregoing discussion discloses and describes merely exemplary embodiments of the present invention. One skilled in the art will readily recognize from such discussion and from the accompanying drawings that various changes, modifications and variations may be made therein without departing from the spirit and scope of the invention.

Claims of the invention:

1. A game device for a user comprising:

a flexible closure for receiving impacts from the user;

one or more filler placed inside said flexible closure for reducing recoiling of said flexible closure from the surface on receiving impacts;

a mechanical unit attached to inner walls of said flexible closure, said mechanical unit comprising:

an electric motor for providing torque;

an impact sensor for sensing the impacts received from the user; and a power source for energizing said electric motor and said impact sensor;

a gravity slowing unit attached to said mechanical unit for reducing the gravitational pull acting on said flexible closure; said gravity slowing unit comprising:

a spring-loaded hinge for stabilizing said flexible closure from impacts projected by said user;

a spring-loaded shaft connected to said electric motor through said spring-loaded hinge, said spring-loaded shaft to rotate on receiving torque from said electric motor;

at least one set of propellers connected to said spring-loaded shaft for receiving torque and providing thrust against gravitational pull acting on said flexible closure.

2. The game device according to claim 1 wherein said one or more filler comprising at least one of: sand; and one or more pellets,

3. The game device according to claim 1 wherein said impact sensor disables said at least one set of propellers for a pre-determined duration after receiving impact from the user on said flexible closure.

4. The game device according to the claim 1 wherein said spring-loaded hinge is a ball hinge.

5. The game device according to the claim 1 further comprising an audio output unit connected to said power source, wherein said impact sensor commands the audio output unit for playing an audio on receiving impact from the user.

6. The game device according to the claim 1 further comprising a visual output unit connected to said power source, wherein said impact sensor commands the visual output unit for playing a visual on receiving impact from the user.

7. The gravity slowing unit according to claim 1 further comprising a ring for circumscribing said at least one set of propellers.

8. The game device according to claim 1 further comprising a casing configured for covering the electric motor and the spring-loaded hinge.

* * * * *